US006769547B2

(12) United States Patent
Yu

(10) Patent No.: US 6,769,547 B2
(45) Date of Patent: Aug. 3, 2004

(54) MULTI-LAYER AIR CUSHION PACKING MATERIAL

(76) Inventor: Hui-Nan Yu, 14, Lane 252, Chien Kuo Road, Taoyuan (TW)

( * ) Notice: Subject to any disclaimer, the term of this patent is extended or adjusted under 35 U.S.C. 154(b) by 91 days.

(21) Appl. No.: 10/138,262

(22) Filed: May 6, 2002

(65) Prior Publication Data

US 2003/0207053 A1 Nov. 6, 2003

(51) Int. Cl.[7] ..... B65D 81/02
(52) U.S. Cl. ..... 206/586; 206/592
(58) Field of Search ..... 206/521, 586, 206/587, 588, 591, 592, 593, 453, 523, 522

(56) References Cited

U.S. PATENT DOCUMENTS 3,980,221 A * 9/1976 Okada ..... 206/521
4,602,715 A * 7/1986 Sarver et al. ..... 206/523
5,339,958 A * 8/1994 Taravella et al. ..... 206/521
5,738,216 A * 4/1998 Warner ..... 206/523
6,405,873 B2 * 6/2002 Koike ..... 206/592

* cited by examiner

*Primary Examiner*—Shian T. Luong
(74) *Attorney, Agent, or Firm*—Troxell Law Office PLLC

(57) ABSTRACT

The present invention is a multi-layer air cushion packing material whose buffer is made of more than two layers formed into one entire layer. The main pad is installed with several raised buffering pieces. The bottom pad is piled up inside the inner pad with several raised arcs on the back board. Between the main pad and the bottom pad is the inner pad with several raised arcs on the back board and the radian of each raised arc is less than that of the buffering pieces on the main pad. With the closely piling between the buffering pieces and the raised arcs and the assistance of the air chamber, the packing material made of two or more pairs of the buffers provides buffering function through the airtight air chamber formed by the piled layers, which in turn achieves better shockproof effect and protects the product.

2 Claims, 8 Drawing Sheets

MULTI-LAYER AIR CUSHION PACKING MATERIAL

FIELD OF THE INVENTION

The present invention is a multi-layer air cushion packing material, especially that provides good packing and buffer effect.

BACKGROUND OF THE INVENTION

Traditionally, the packing of the electric or computer-related products, such as scanners, PC, notebooks, portable electric communication products, other computer peripheral products, office automatic products and the likes, is done by covering the edges or corners with PEF, such as polystyrene, as the buffer and then be sold with the package of corrugated boxes.

The polystyrene of the buffer mentioned above is made of the full all-in-one PEF that provide better buffer. The manufacturing process, however, causes damage to human bodies and pollution to the environment, which obviously go against the concept of environmental protection. The other buffer made of corrugated paper is knocked out of shaped by over powerful shocks and causes damage to the product, though the space for taking apart does provide buffering effect.

In view of the disability of the foregoing buffer in truly reducing the shocks, the inventor plans a three-dimensional packing material that provides air-cushion effect.

SUMMARY OF THE INVENTION

The objective of the present invention is to provide an easy-assembling and easy-dismantling structure through piling layer by layer with the air chamber in each layer to form closed space inside the buffer, which in turn achieves a better buffer mechanism.

In the following, the embodiment illustrated is used to describe the detailed structural characteristics and operation action for the present invention.

DETAILED DESCRIPTION OF THE INVENTION

Figure 1:
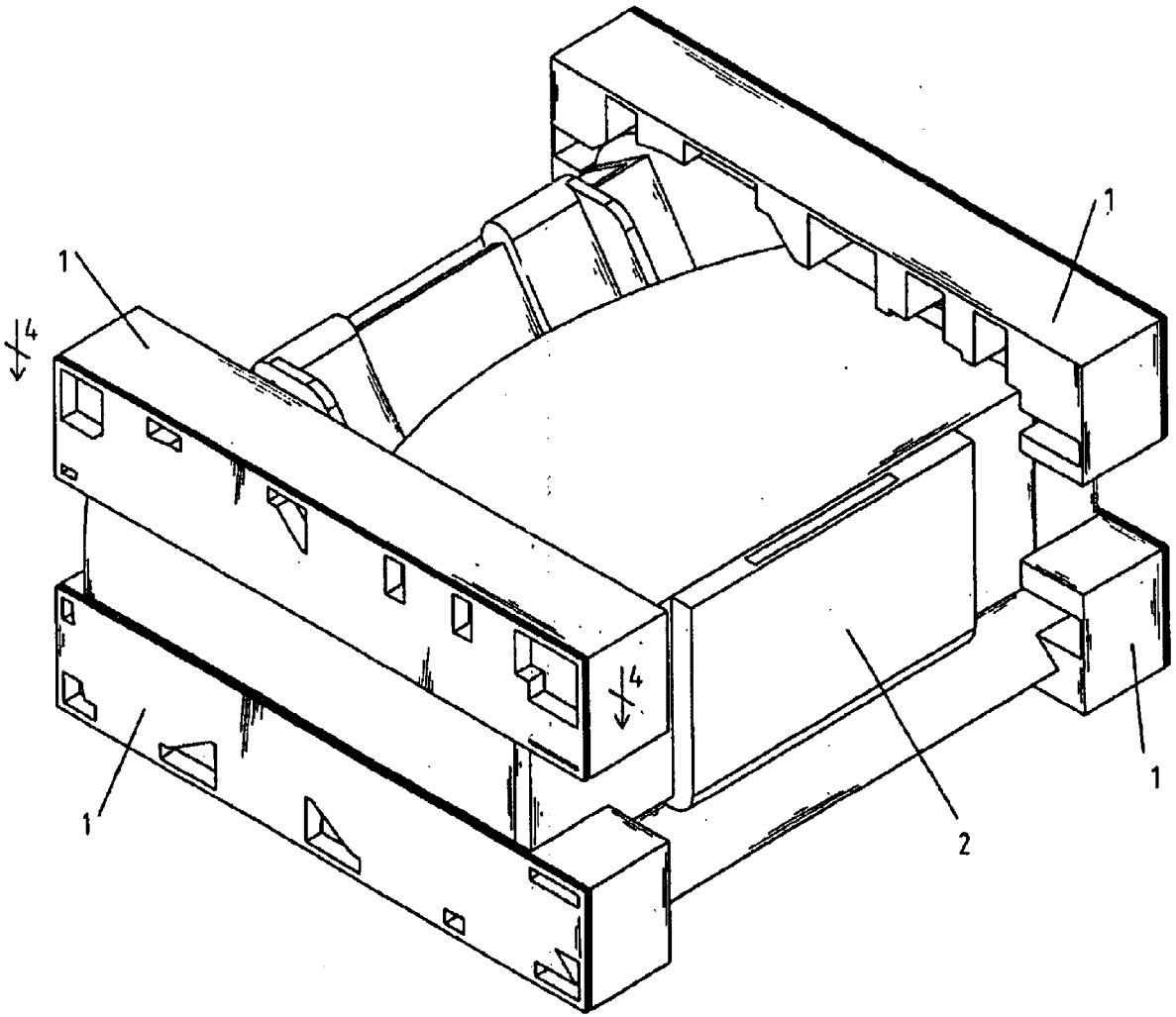
FIG. 1 is a three-dimensional operation illustration for the present invention.
Figure 2:
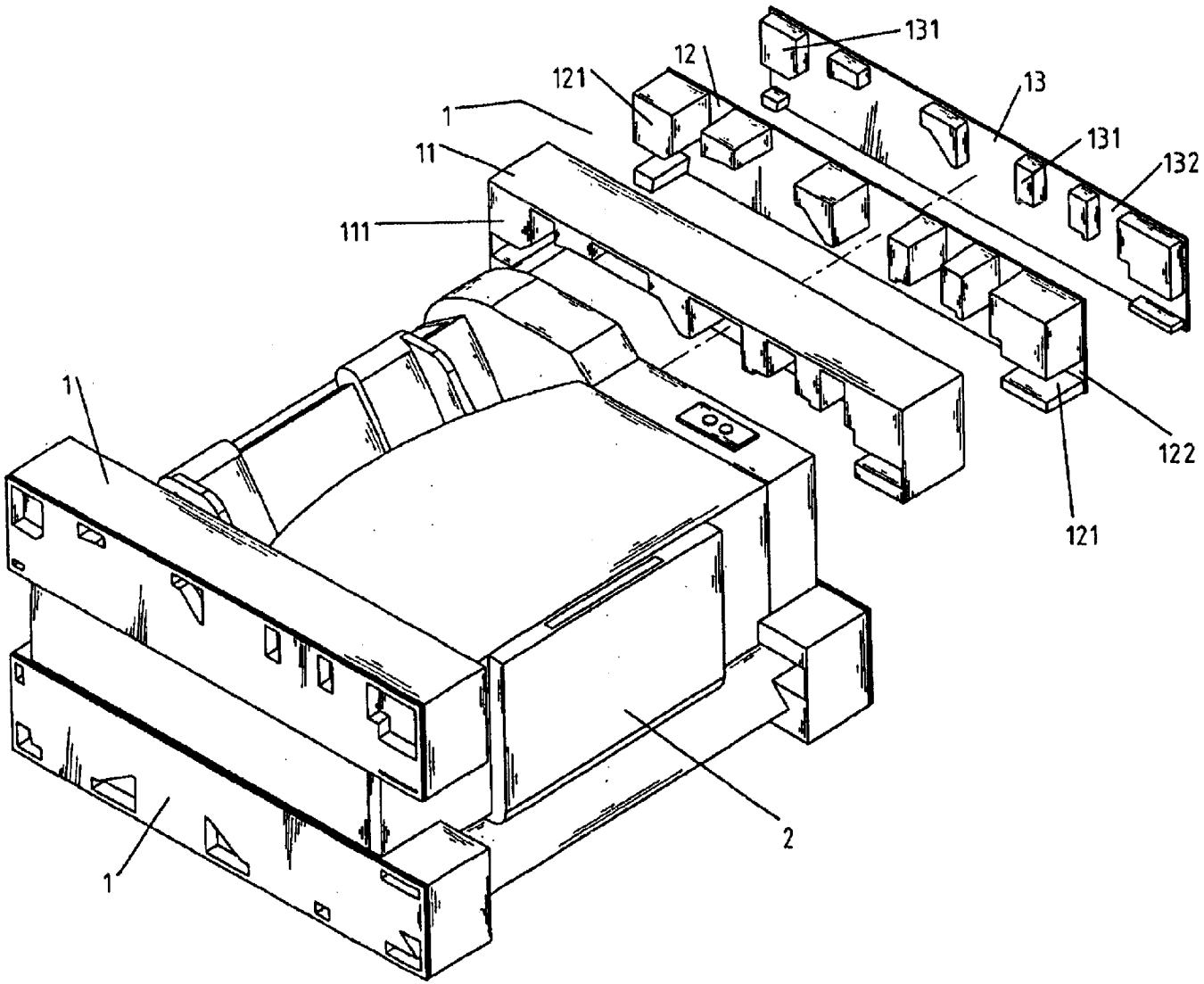
FIG. 2 is a three-dimensional discompose illustration in part for the present invention.
Figure 3:
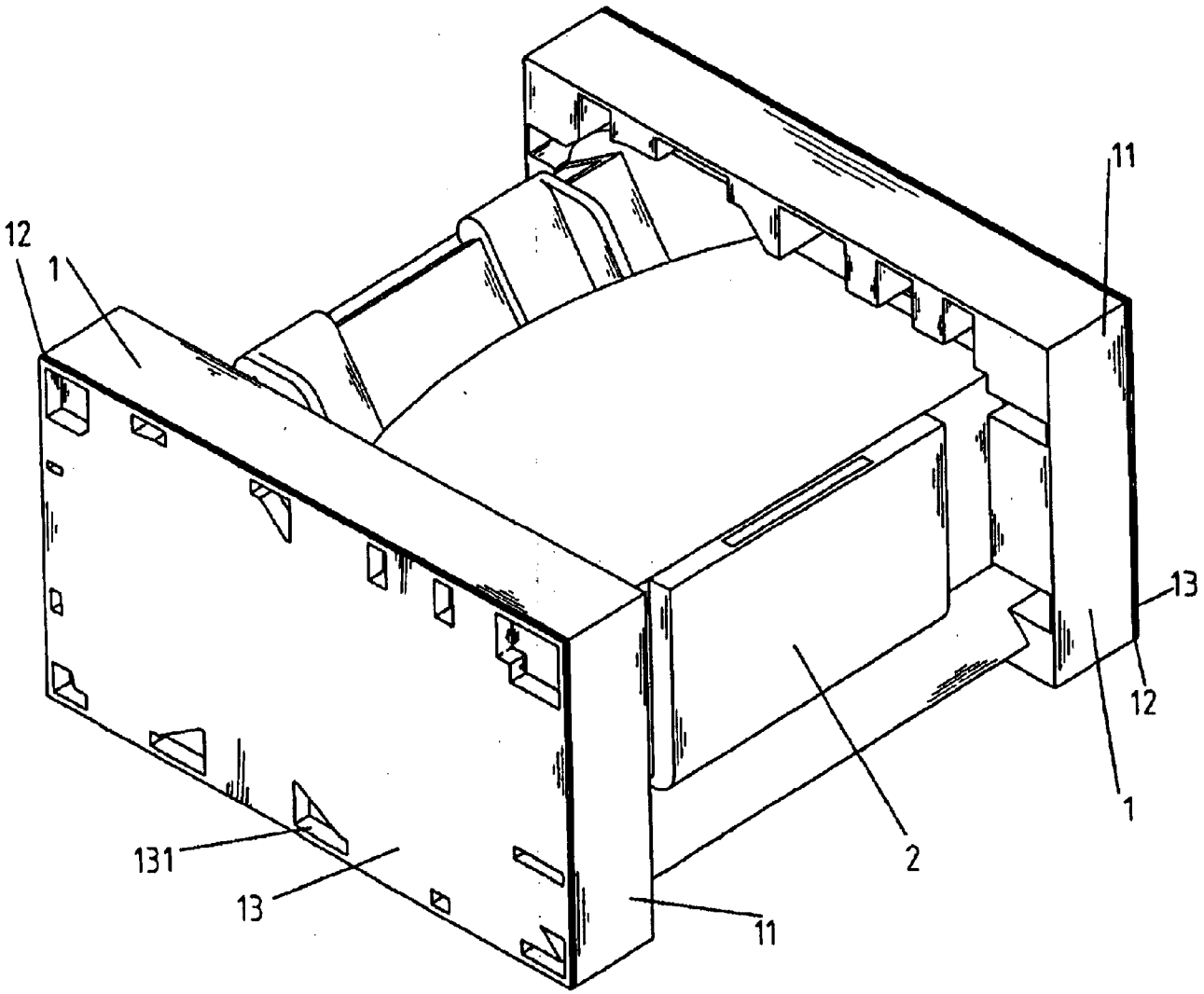
FIG. 3 is a three-dimensional operation illustration for the present invention.
Figure 4:
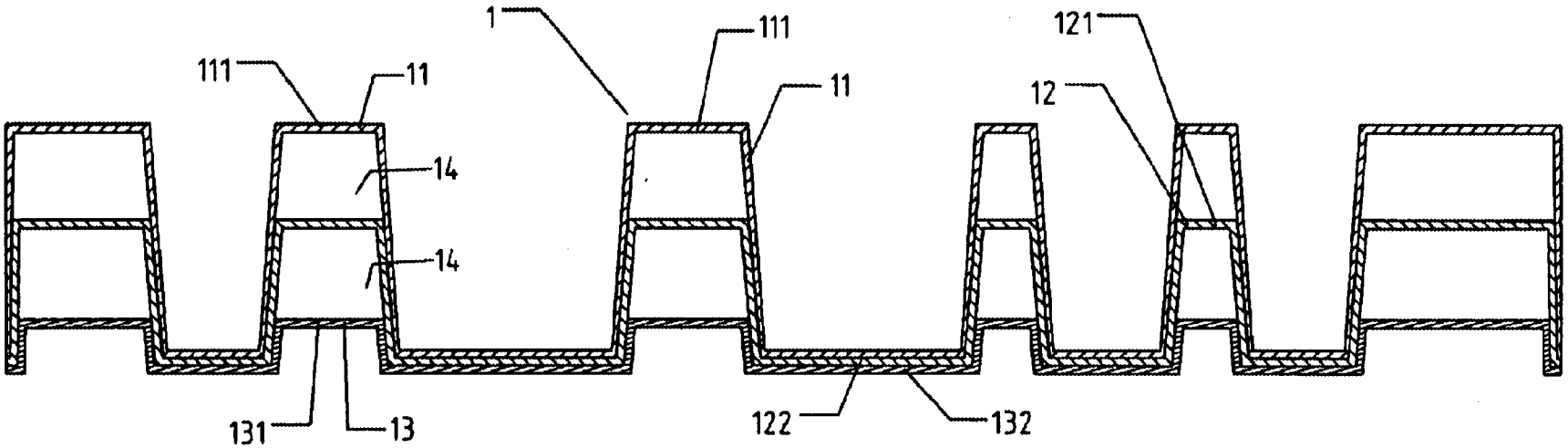
FIG. 4 is a cross-section illustration from the direction of the 4—4 cross-section tangent and the arrows in FIG. 1.

Please refer to FIGS. 1 to 3. The user can install a set of four buffers on the four edges or four corners of the product or a pair of the buffers on the top and the bottom of the product, which provide sufficient strength and buffering to achieve collision-resistant shockproof and assure the security of the packed product.

The foregoing buffer 1 is made of more than two layers of the main pad 11 and the bottom pad 13. Inside the main pad 11 are several indented buffering pieces 111 designed for the connection with the surface of the electric products 2. The main pad 11 act as a mask with several raised hollow buffering pieces 111. The bottom pad 13 is stacked inside the inner pad 12 with several raised arcs 131 on the back board 132 of the bottom pad 13. Between the main pad 11 and the bottom pad 13 is the inner pad 12 with several raised arcs 121 on the back board 122 of the inner pad 12, the peak of each arc 121 less than the buffering pieces 111 of the main pad 11 which forms the airtight air chamber 14 between the buffering pieces 111 and the raised arcs 121. A drop exists between each arc 131 and each of the arcs 121 on the inner pad 12, allowing the piled space between the raised arcs 121 of the inner pad 12 and the raised arcs 131 of the bottom pad 13 to form the air chamber 14. The bottom pad 13 lies on the outside. The tight piling of the main pad 11, the inner pad 12 and the bottom pad 13 allows the space between the buffering pieces 111 and the raised arcs 121, 131 to form the air chamber, so as to prevent the air from leaking out when the buffer 1 is collided and pressed.

Each air chamber 14 takes shape from the height drop between the buffering pieces 111 and the raised arcs 121, 131. The buffering pieces 111 and the raised arcs 121, 131 are connected tightly by the edge to present the air from leaking out under pressure, which in turn too achieve better buffering effect.

When the buffer 1 is placed on the edge of the product 2, the piling of the buffer 1 forms several air chambers 14 inside the buffer 1. Each air chamber 14 is propped up and protected by the ribs formed by the buffering pieces 111 and the raised arcs 121, 131. During collision, the air chambers inside the buffer 1 that contact direct with the product 2 provide good shockproof effect. Moreover, the air cushion buffering provided by the buffer 1 is flexible enough to reduce the shock significantly as well as protect the packaged product 2.

Figure 5:
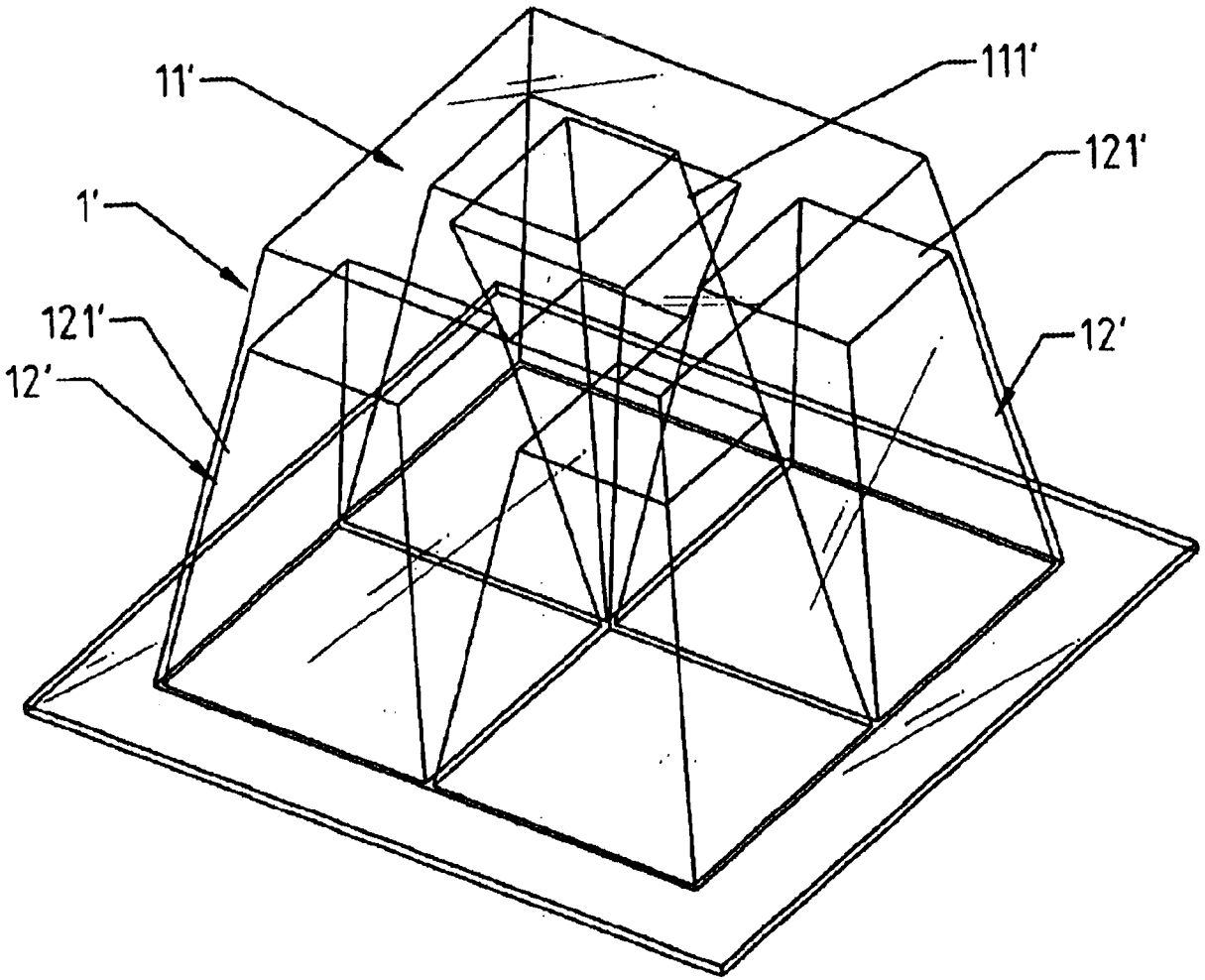
FIG. 5 is a first appearance illustration of the buffering mechanism for the present invention.
Figure 6:
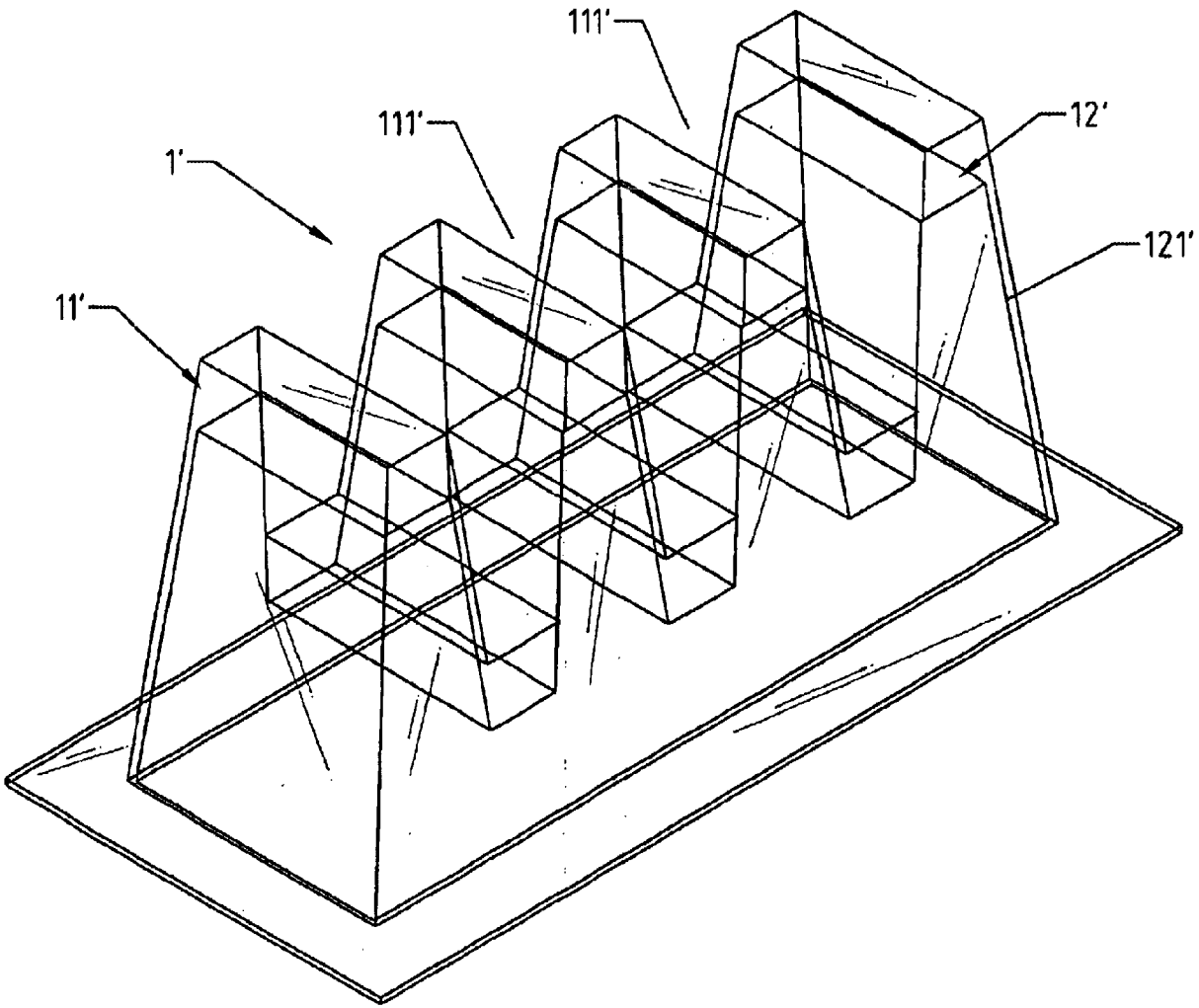
FIG. 6 is a second appearance illustration of the buffering mechanism for the present invention.

Please refer to FIG. 5, the buffer 1' is made of at least two layers of buffering material. On the indented center of the main pad 11 is the positioning fillister 111'. Several propping raised ribs 121' are aligned on the inner pad 12 to inset and combine with the positioning fillisters 111' so as to support and position the propping raised ribs 121' through the positioning fillisters 111'. The structure in FIG. 6 resembles to the foregoing structure in which the inner pad 12' of the buffer 1' is installed with several connected propping raised ribs 121'. Beneath the top of the main pad 11' are several positioning fillisters 111' located correspondingly between each propping raised rib 121' that clench each other to position each propping raised rib 121'. With the hollow space inside the propping raised ribs 121', the buffer provides excellent buffering effect during shocks.

Figure 7:
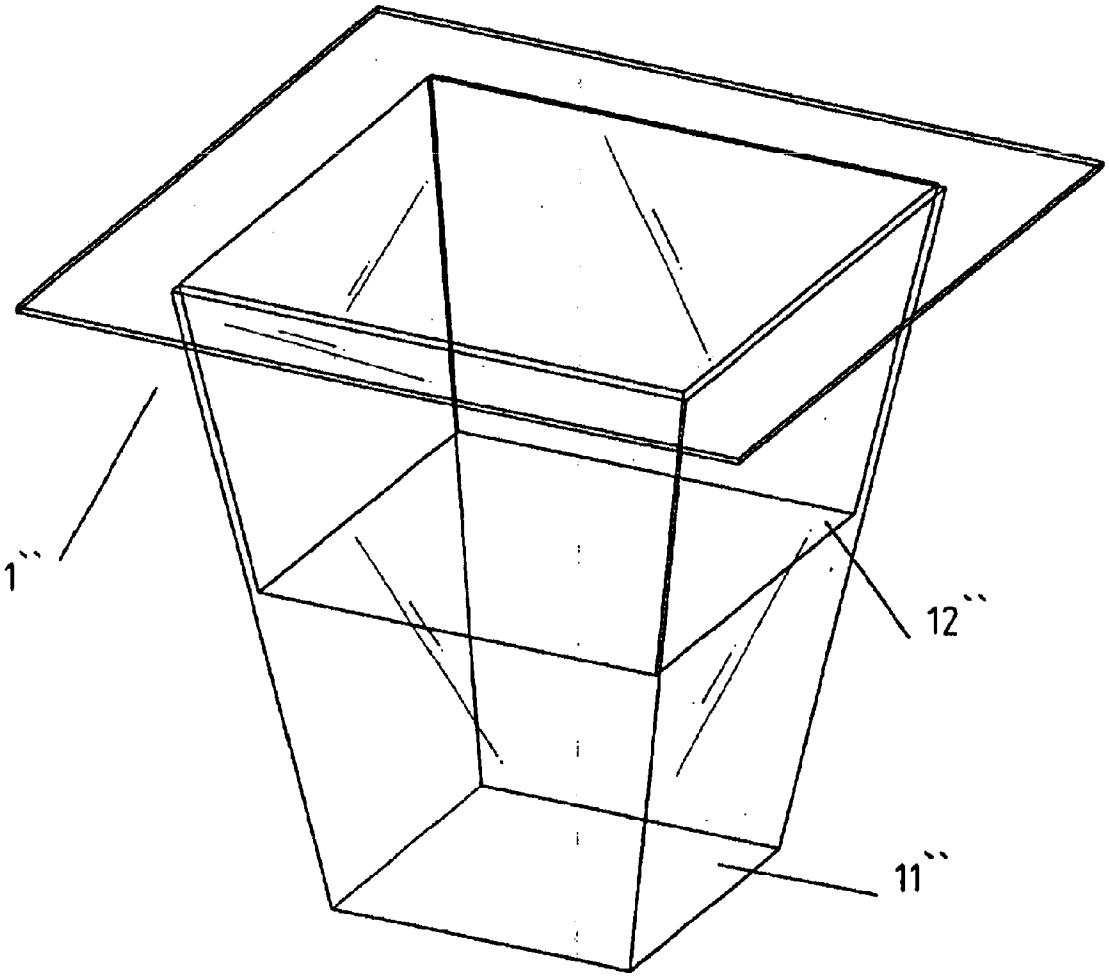
FIG. 7 is a third appearance illustration of the buffering mechanism for the present invention.

Please refer to FIG. 7. The buffer 1" can be further piled up in which the taper-shaped main pad 11" is piled upon the same shaped yet lower inner pad 12", so as to form the air chamber between the main pad 11 and the inner pad 12" and provides buffering effect under pressure.

Figure 8:
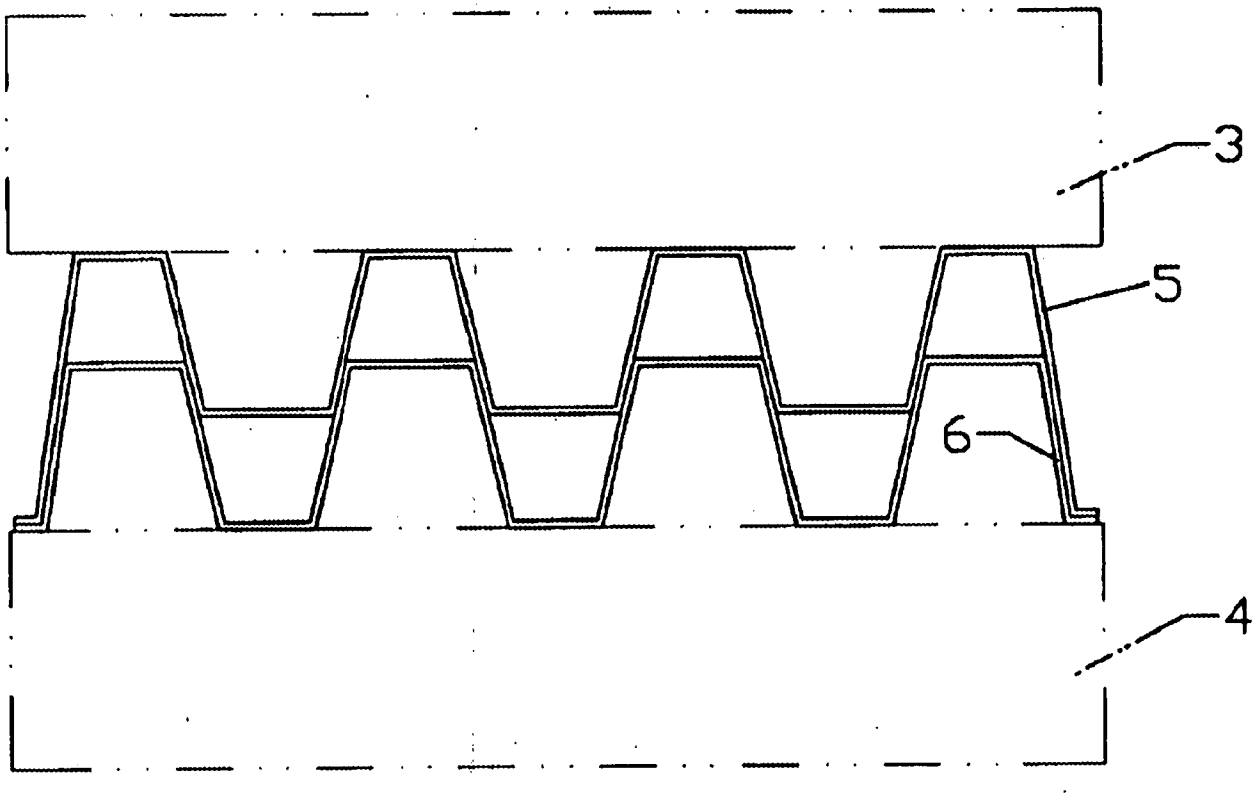
FIG. 8 is a forth appearance illustration of the buffering mechanism for the present invention.

Please refer to FIG. 8. Besides placing the foregoing buffer on the four edges or the four corners of the products, the user can also place it between the products 3, 4 to provide buffering effect. With the connected ridges on the main pad 5 and the bottom pad 6 and the buffering air chambers between both, the collision between the products 3, 4 is eliminated and the shock is reduced.

What is claimed is:

1. A multi-layer air cushion packing material for covering edges, corners or surfaces on both sides of a product so as to provide a buffering effect during shocks, comprising a plurality of buffers, each buffer including combined first pad and second pad, an inside of said first pad having a plurality of raised buffering pieces to contact with the product, said first pad acting as a mask with a plurality of hollow and raised buffering pieces on one side, said second pad located inside said first pad with a plurality of raised arcs on a back board of said second pad, the raised arcs of said second pad and the raised buffering pieces of said first pad forming air chambers;

said buffering pieces, said raised arcs of said buffer and said air chambers providing a buffering effect for said products, and further comprising, a third pad with a plurality of second raised arcs on a back board installed between said first pad and said second pad, a radian of each second raised arc is less than that of said buffering piece on said first pad forming air chambers between said buffering pieces and said second raised arcs.

2. A multi-layer air cushion packing material for covering edges, corners or surfaces on both sides of a product so as to provide a buffering effect during shocks, comprising a plurality of buffers, each buffer including combined first pad and second pad, an inside of said first pad having a plurality of raised buffering pieces to contact with the product, said first pad acting as a mask with a plurality of hollow and raised buffering pieces on one side, said second pad located inside said first pad with a plurality of raised arcs on a back board of said second pad, the raised arcs of said second pad and the raised buffering pieces of said first pad forming air chambers;

said buffering pieces, said raised arcs of said buffer and air chambers providing a buffering effect for said products, wherein said buffer further comprises at least two layers of buffering materials, an indented center of said first pad including a positioning fillister, several propping raised ribs are aligned inside said second pad to inset and combine with said positioning fillister, and support and position said propping raised ribs with said positioning fillister.

* * * * *